US007922634B1

(12) United States Patent
Wu

(10) Patent No.: US 7,922,634 B1
(45) Date of Patent: Apr. 12, 2011

(54) PULL EXERCISER

(76) Inventor: Ying-Ching Wu, An-Ding Shiang (TW)

( * ) Notice: Subject to any disclaimer, the term of this patent is extended or adjusted under 35 U.S.C. 154(b) by 0 days.

(21) Appl. No.: 12/849,080

(22) Filed: Aug. 3, 2010

(51) Int. Cl.
*A63B 21/02* (2006.01)

(52) U.S. Cl. ..... 482/126; 482/121

(58) Field of Classification Search ..... 482/81, 482/82, 121–130
See application file for complete search history.

(56) References Cited

U.S. PATENT DOCUMENTS

| | | | | |
|---|---|---|---|---|
| 1,019,861 | A * | 3/1912 | Titus | 482/123 |
| 3,256,015 | A * | 6/1966 | Perrin | 482/129 |
| 3,550,312 | A * | 12/1970 | East | 446/247 |
| 4,204,674 | A * | 5/1980 | Ogland | 482/131 |
| 4,518,162 | A * | 5/1985 | Oates | 482/93 |
| D280,840 | S * | 10/1985 | Dzitzer | D21/679 |
| 4,618,142 | A * | 10/1986 | Joseph, Jr. | 482/82 |
| 4,793,609 | A * | 12/1988 | Coutts et al. | 482/122 |
| 5,125,649 | A * | 6/1992 | Fuller | 482/123 |
| 5,314,396 | A * | 5/1994 | Parr | 482/126 |
| 5,556,368 | A * | 9/1996 | Akin | 482/124 |
| 5,588,942 | A * | 12/1996 | Dillard | 482/139 |
| 5,709,630 | A * | 1/1998 | Froelich et al. | 482/46 |
| 5,746,687 | A * | 5/1998 | Vial et al. | 482/126 |
| 5,885,196 | A * | 3/1999 | Gvoich | 482/125 |
| 6,648,804 | B2 * | 11/2003 | Chen | 482/125 |
| 7,322,909 | B1 * | 1/2008 | Loccarini et al. | 482/129 |
| 7,326,157 | B2 | 2/2008 | Wu | 82/126 |
| 7,357,762 | B1 * | 4/2008 | Terry et al. | 482/126 |
| 7,387,599 | B1 * | 6/2008 | Hsu | 482/132 |
| 7,465,259 | B2 * | 12/2008 | Mok | 482/126 |
| 7,578,775 | B2 * | 8/2009 | Terry | 482/126 |
| 7,846,079 | B1 * | 12/2010 | Eaglin | 482/126 |
| 2007/0117688 | A1 * | 5/2007 | Sewitch et al. | 482/83 |
| 2007/0254786 | A1 * | 11/2007 | Owen | 482/121 |
| 2007/0287614 | A1 * | 12/2007 | Fuller | 482/121 |
| 2008/0280738 | A1 * | 11/2008 | Brennan et al. | 482/129 |
| 2009/0275449 | A1 * | 11/2009 | Terry | 482/139 |
| 2009/0280965 | A1 * | 11/2009 | Shapiro et al. | 482/72 |
| 2010/0152002 | A1 * | 6/2010 | Knight | 482/93 |
| 2010/0173760 | A1 * | 7/2010 | Hall | 482/129 |
| 2011/0028288 | A1 * | 2/2011 | Anderson | 482/124 |

* cited by examiner

*Primary Examiner* — Loan Thanh
*Assistant Examiner* — Daniel F Roland
(74) *Attorney, Agent, or Firm* — Alan Kamrath; Kamrath & Associates PA

(57) ABSTRACT

A pull exerciser includes a bar and an engaging hole extending from an end through the other end of the bar. The pull exerciser further includes two handles each having a grip portion and a connecting portion spaced from the grip portion along a longitudinal axis and a cord mounting section intermediate the grip portion and the connecting portion. The connecting portion of each handle is releasably mounted to one of the ends of the bar. The cord mounting section of each handle includes three through-holes spaced along the longitudinal axis. An end of the first elastic cord is extended through and retained in the through-holes of the cord mounting section of one of the handles. The other end of the first elastic cord or an end of a second elastic cord can be extended through and retained in the through-holes of the cord mounting section of the other handle.

8 Claims, 15 Drawing Sheets

PULL EXERCISER

BACKGROUND OF THE INVENTION

The present invention relates to a pull exerciser and, more particularly, to a pull exerciser having a length-adjustable elastic cord while allowing easy assembly.

Pull exercises with stretchable elastic cords allow exercising of selected muscles such as muscles of the chest and the arms. Some of the pull exercisers with stretchable elastic cords are lightweight and small in size to allow easy carriage. One type of such pull exercisers includes a bar and an elastic cord having two ends respectively attached to two ends of the bar. In use, the user positions an intermediate portion of the elastic cord with one or both feet to retain the elastic cord and grips the ends of the bar with both hands and repeatedly raises the bar to the chest or head level for exercising the muscles of the chest and the arms.

U.S. Pat. No. 7,326,157 discloses an exercise device including a bar and two tubular handles releasably coupled to two ends of the bar. An attachment member is attached to each handle. The attachment members are releasably coupled with two end pieces respectively on two ends of an elastic member via hooks. However, assembly of the exercise device is troublesome and costly. Furthermore, a plug must be inserted into each end of the elastic member to enlarge the diameter before the end of the elastic member is engaged with one of the end pieces, which is time-consuming. Furthermore, the exercise device is not suitable for different users having different heights.

Thus, a need exists for a pull exerciser having a length-adjustable elastic cord while allowing easy assembly.

BRIEF SUMMARY OF THE INVENTION

The present invention solves this need and other problems in the field of adjustable pull exercisers by providing, in a preferred form, a pull exerciser including a bar having first and second ends spaced along a first longitudinal axis and an engaging hole extending from the first end through the second end along the first longitudinal axis. The pull exerciser further includes first and second handles each having a grip portion and a connecting portion spaced from the grip portion along a second longitudinal axis and a cord mounting section intermediate the grip portion and the connecting portion. The connecting portion of each of the first and second handles is releasably mounted to one of the first and second ends of the bar. The cord mounting section of each of the first and second handles includes first, second, and third through-holes spaced along the second longitudinal axis. A first elastic cord includes first and second ends. The first end of the first elastic cord extends through and is retained in the first, second, and third through-holes of the cord mounting section of the first handle.

In a preferred form, the second end of the first elastic cord is extended through and retained in the first, second, and third through-holes of the cord mounting section of the first handle.

In another preferred form, an end of a second elastic cord is extended through and retained in the first, second, and third cord mounting section of the second handle.

In a preferred form, the first, second, and third through-holes are parallel to each other.

In another preferred form, the first, second, and third through-holes are at a non-parallel angle to each other.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
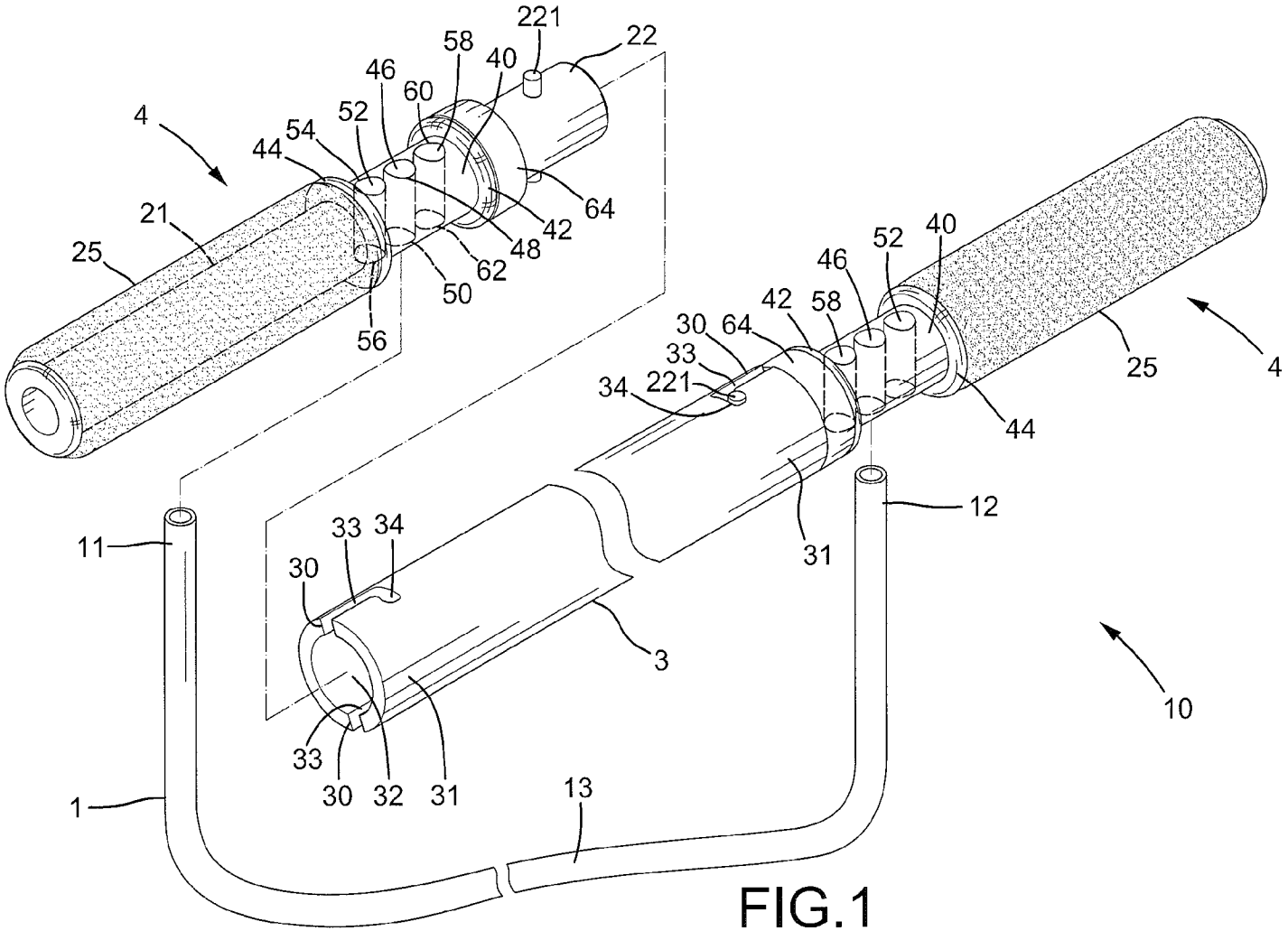
FIG. 1 shows a partial, exploded, perspective view of a pull exerciser of an embodiment according to the preferred teachings of the present invention.
Figure 2:
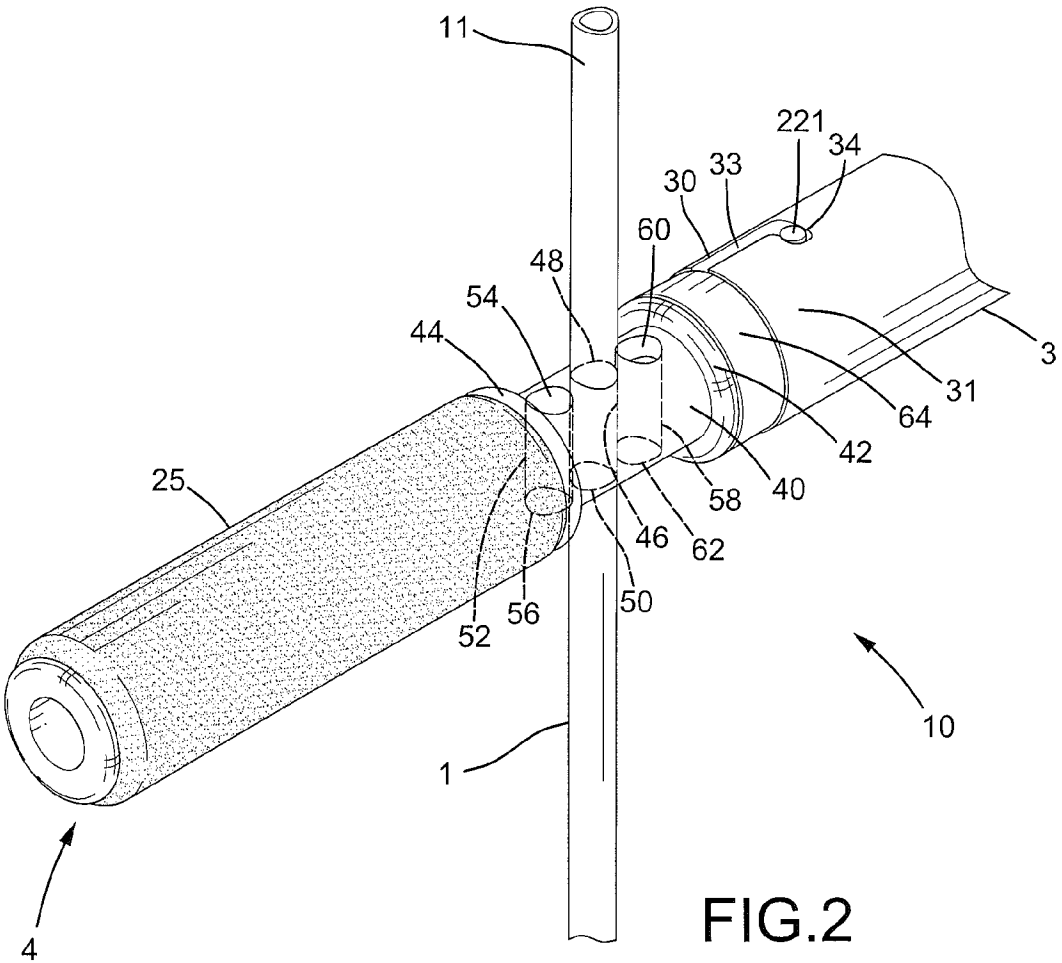
FIG. 2 shows a partial, perspective view of the pull exerciser of FIG. 1 with an end of an elastic cord extended through a first through-hole of a handle.
Figure 3:
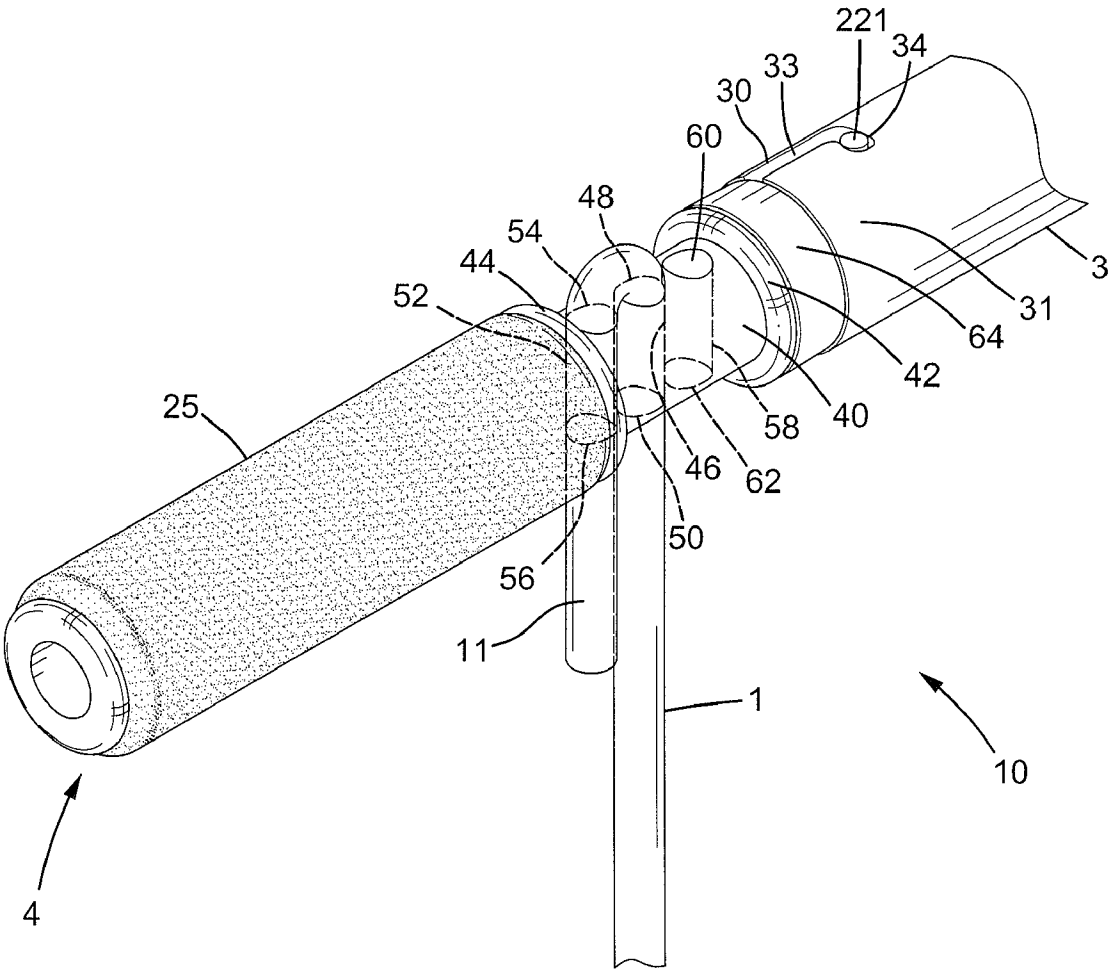
FIG. 3 shows a partial, perspective view of the pull exerciser of FIG. 2 with the end of the elastic cord extended through a second through-hole of the handle.
Figure 4:
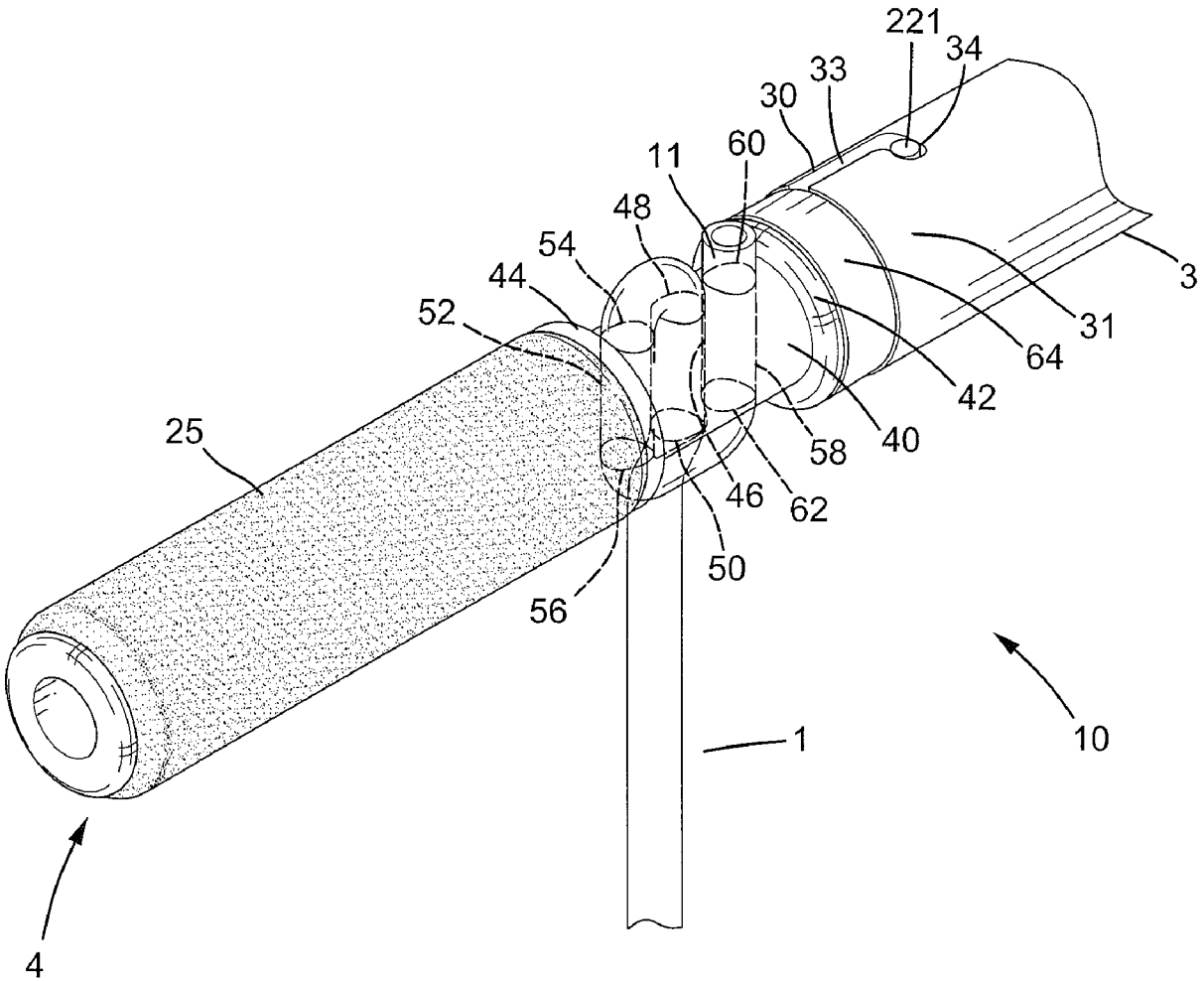
FIG. 4 shows a partial, perspective view of the pull exerciser of FIG. 3 with the end of the elastic cord extended through a third through-hole of the handle.
Figure 5:
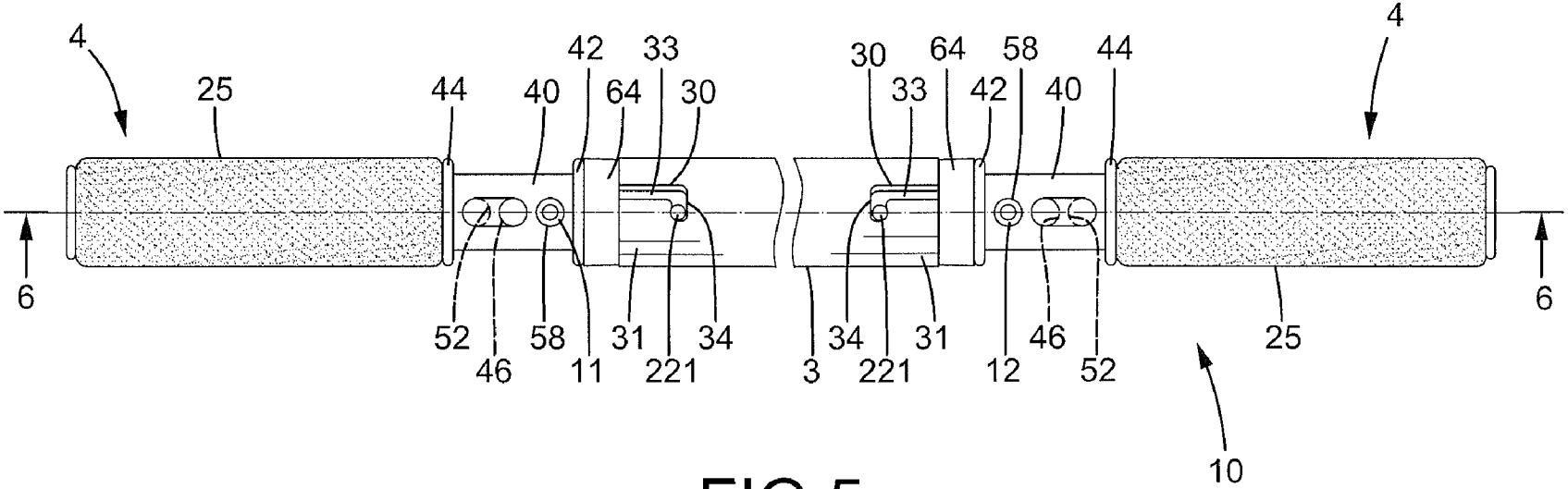
FIG. 5 shows a partial, top view of the pull exerciser of FIG. 1 after assembly.
Figure 6:
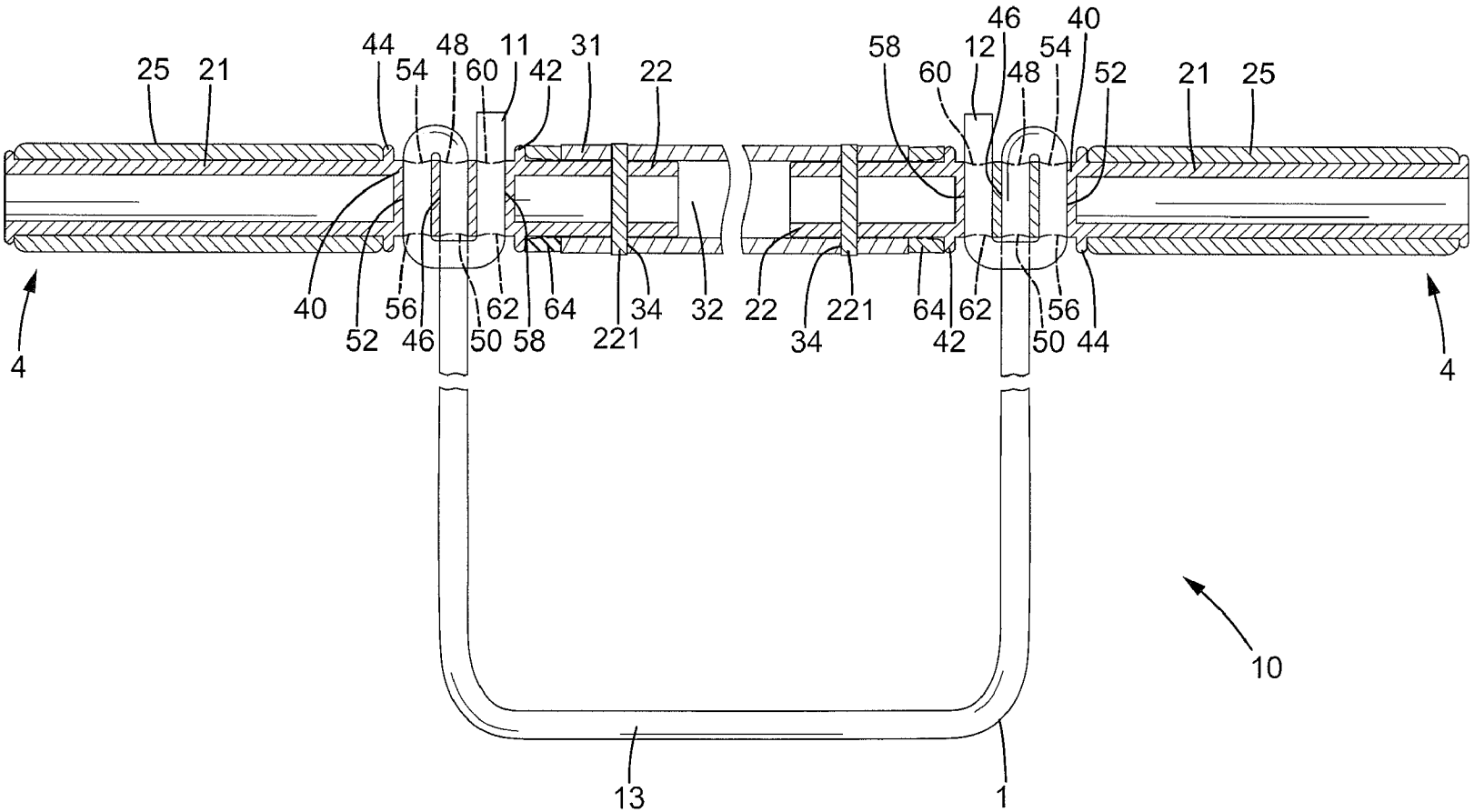
FIG. 6 shows a cross sectional view of the pull exerciser of FIG. 5 according to section line 6-6 of FIG. 5.
Figure 7:
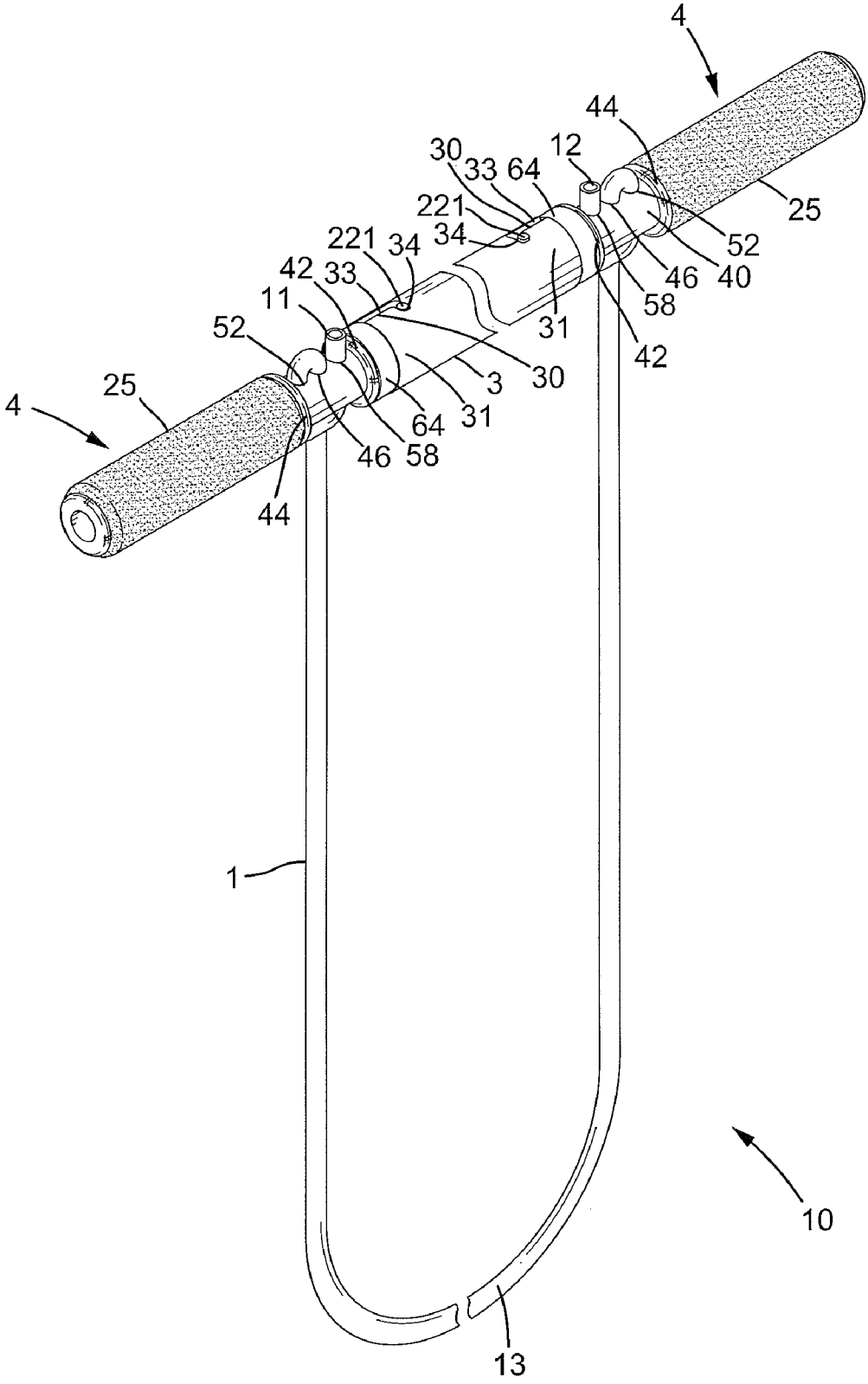
FIG. 7 shows a partial, perspective view of the pull exerciser of FIG. 1 after assembly.
Figure 8:
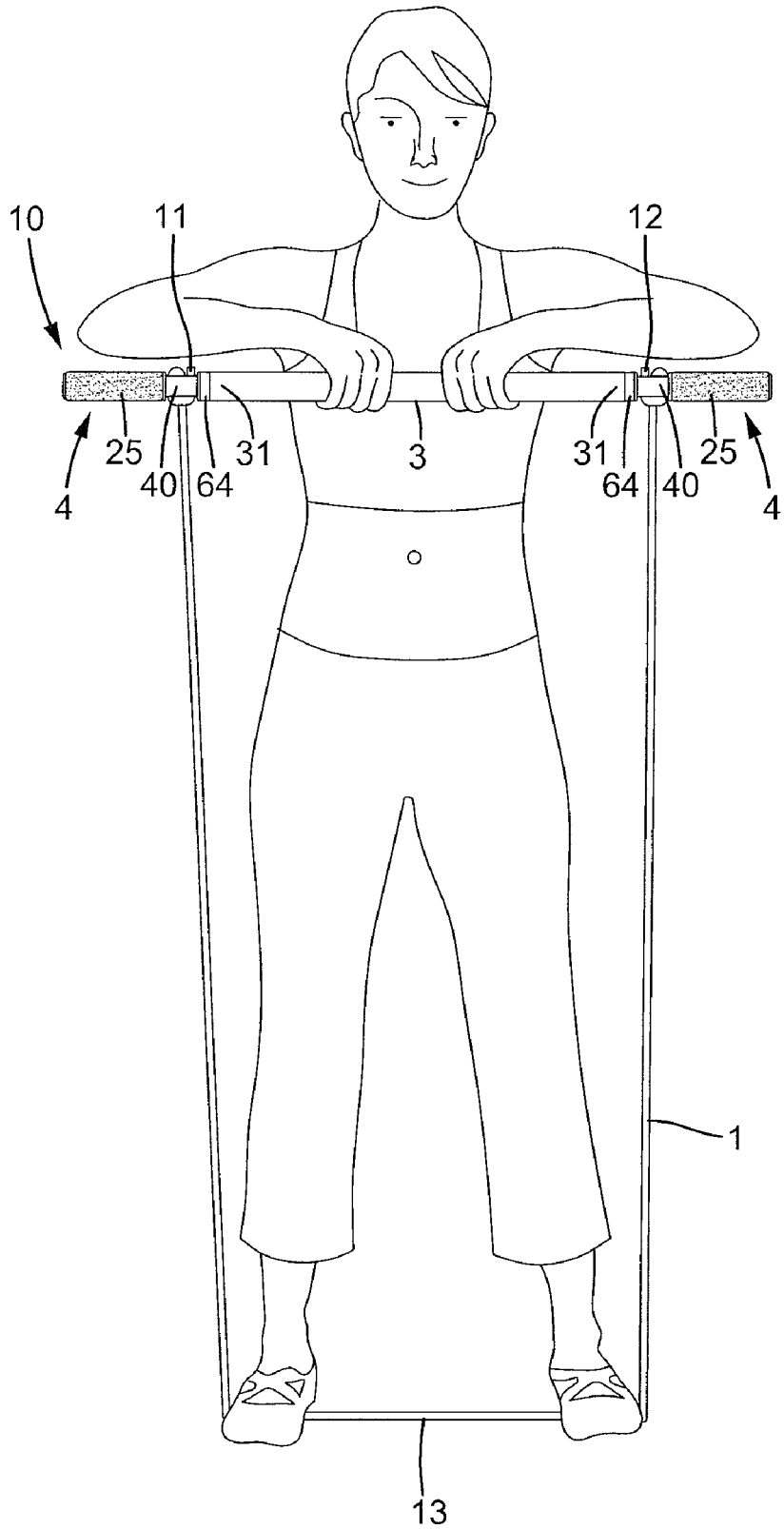
FIG. 8 shows a perspective view illustrating a first example of use of the pull exerciser of FIG. 1.
Figure 9:
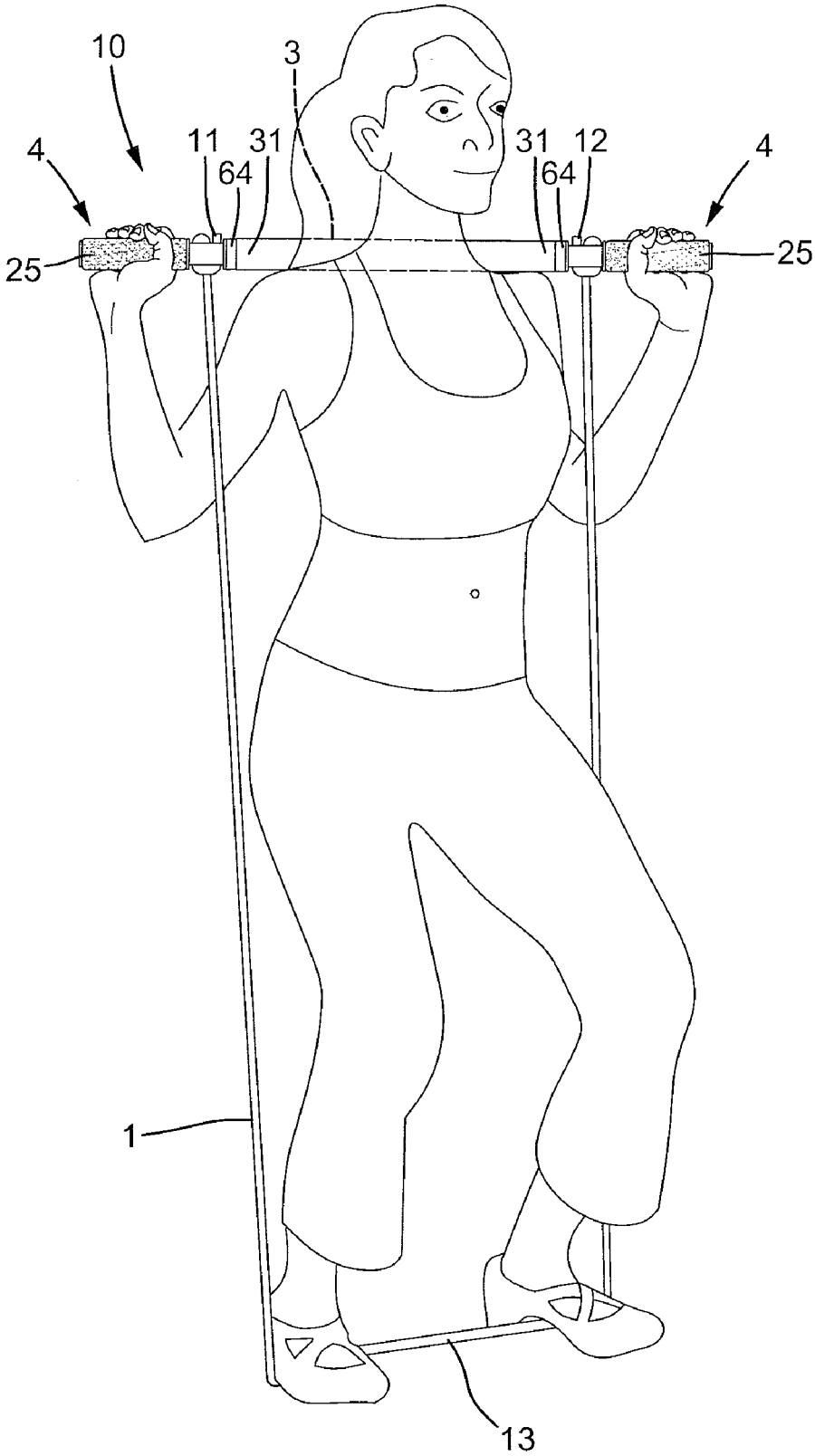
FIG. 9 shows a perspective view illustrating a second example of use of the pull exerciser of FIG. 1.
Figure 10:
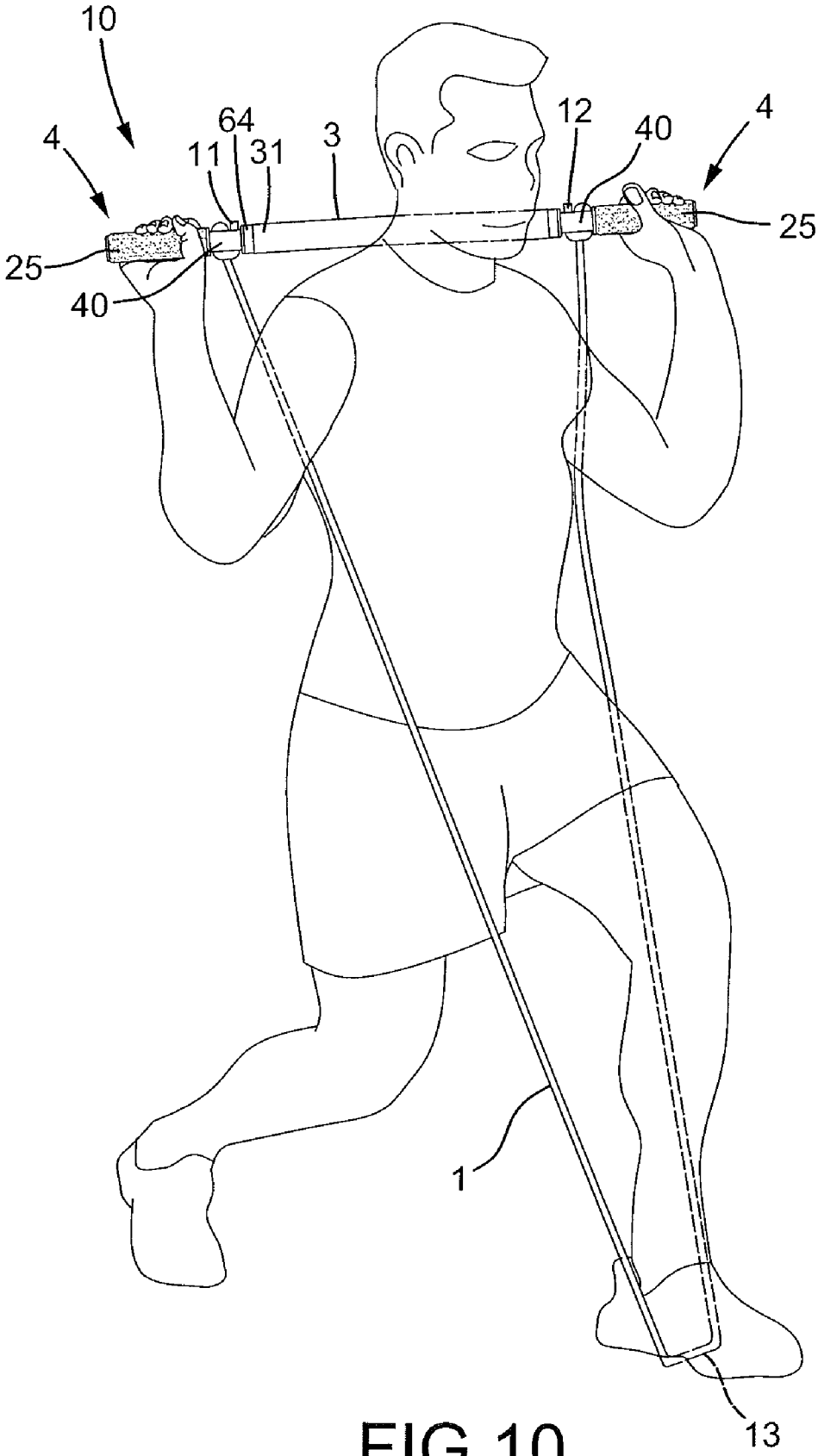
FIG. 10 shows a perspective view illustrating a third example of use of the pull exerciser of FIG. 1.
Figure 11:
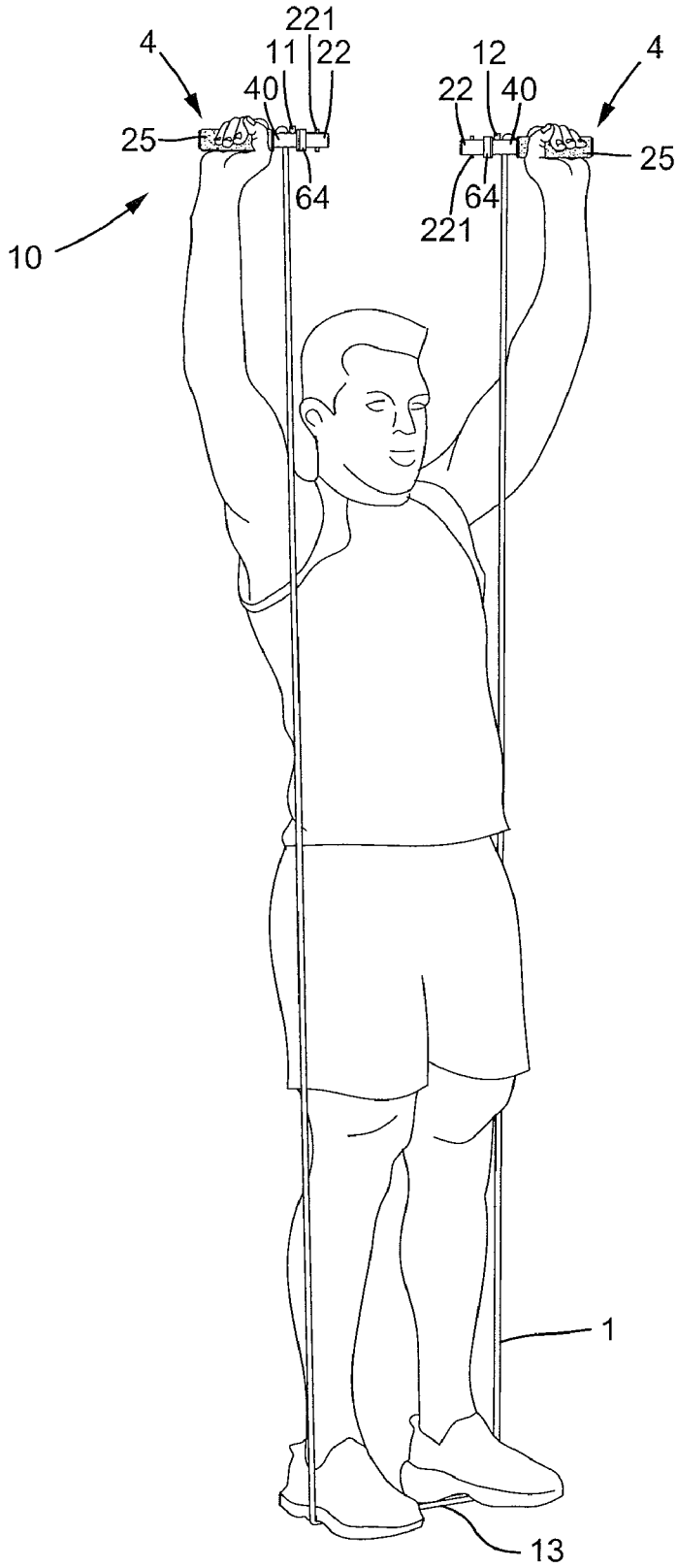
FIG. 11 shows a perspective view illustrating a fourth example of use of the pull exerciser of FIG. 1.
Figure 12:
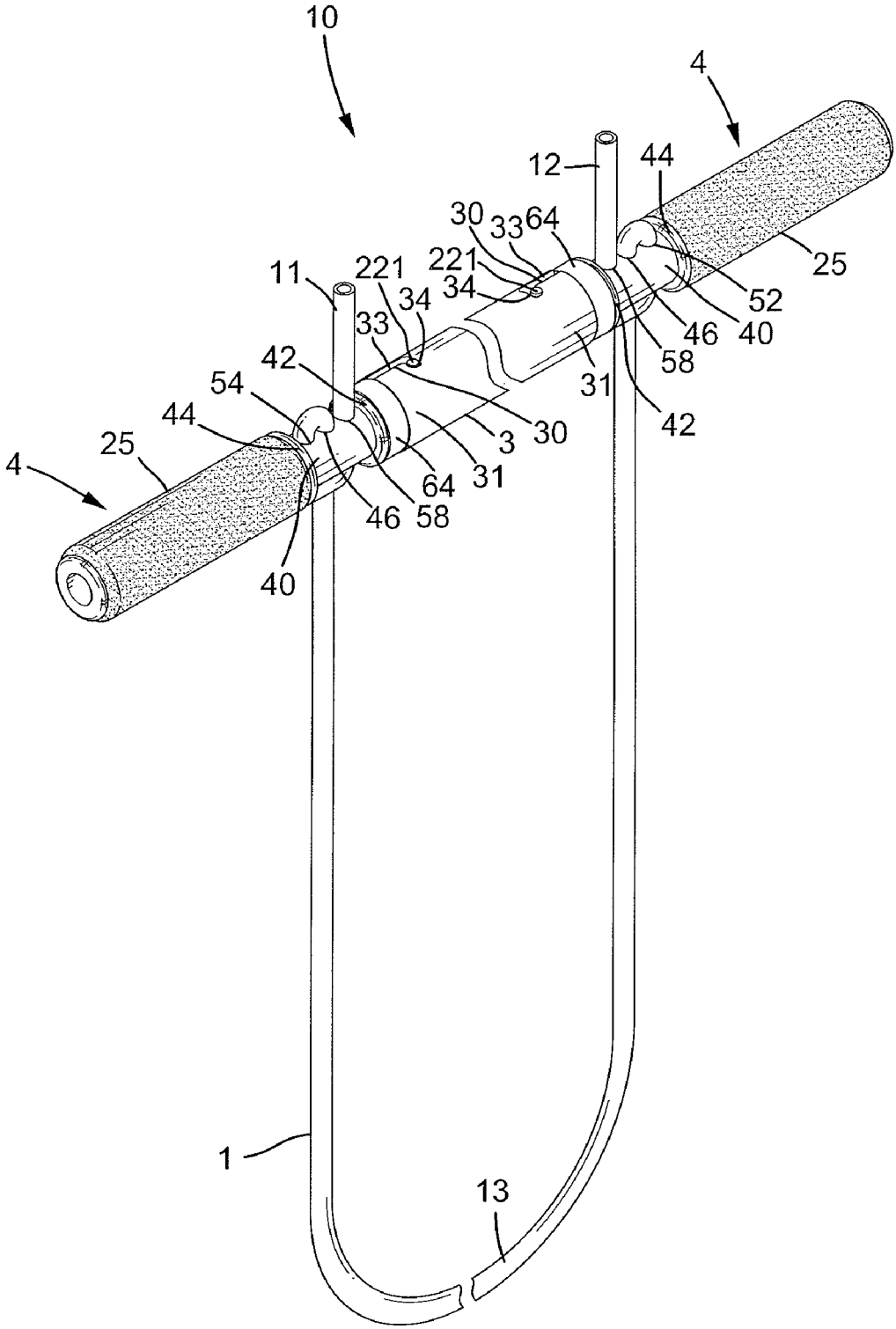
FIG. 12 shows a perspective view of the pull exerciser of FIG. 1 with an operative length of the elastic cord shortened.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "end", "portion", "section", "longitudinal", "lateral", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A pull exerciser according to the preferred teachings of the present invention is shown in the drawings and generally designated 10. In preferred forms shown in FIGS. 1-15, pull exerciser 10 includes a bar 3 having two ends 31 spaced along a first longitudinal axis. An engaging hole 32 extends from one of ends 31 through the other end 31 along the first longitudinal axis. Each end 31 of bar 3 includes two diametrically disposed grooves 30 each having a longitudinal section 33 extending from the end 31 towards but spaced from the other end 31. Each groove 30 further includes a transverse section 34 extending perpendicularly to the longitudinal section 33 from an inner end of longitudinal section 33. It can be appreciated that transverse section 34 can extend from a point other than the inner end of longitudinal section 33.

In the preferred forms shown in FIGS. 1-15, pull exerciser 10 further includes first and second handles 4 each having a grip portion 21 and a connecting portion 22 spaced from grip portion 21 along a second longitudinal axis and a cord mounting section 40 intermediate grip portion 21 and connecting portion 22. A first flange 44 is formed between grip portion 21 and an end of cord mounting section 40 of each of first and second handles 4. A second flange 42 is formed on connecting portion 22 and the other end of cord mounting section 40 of each of first and second handles 4. Thus, cord mounting section 40 is intermediate first and second flanges 42 and 44.

In the preferred forms shown in FIGS. 1-15, a padding member 25 made of foam material or the like is mounted around grip portion 21 of each of first and second handles 4 to provide firm gripping by a user. An end of padding member 25 abuts against first flange 44, preventing padding member 25 from entering cord mounting section 40.

In the preferred forms shown in FIGS. 1-15, connecting portion 22 of each of first and second handles 4 includes an engaging member 221 in the form of a pin extending through a through-hole of connecting portion 22 extending perpendicularly to the second longitudinal axis, leaving two ends of engaging member 221 exposed out of connecting portion 22. A padding member 64 made of resilient material such as rubber is mounted around connecting portion 22 and abuts second flange 42.

In the preferred forms shown in FIGS. 1-15, cord mounting section 40 of each of first and second handles 4 includes first, second, and third through-holes 46, 52, and 58 spaced along the second longitudinal axis with first through-hole 46 intermediate second and third through-holes 52 and 58. First through-hole 46 has first and second openings 48 and 50. Second through-hole 52 has first and second openings 54 and 56. Third through-hole 58 has first and second openings 60 and 62. In the preferred forms shown in FIGS. 1-14, first, second, and third through-holes 46, 52, and 58 are parallel to each other. First openings 48, 54, and 60 are aligned with each other along the second longitudinal axis. Second openings 50, 56, and 62 are aligned with each other along the second longitudinal axis. In the preferred form shown in FIG. 15, first, second, and third through-holes 46, 52, and 58 are at a non-parallel angle in the order of 60° to each other.

In assembly, connecting portion 22 of each of first and second handles 4 is inserted into an end of engaging hole 32 via one of ends 31 of bar 3 until the exposed ends of engaging member 221 reach the inner ends of longitudinal sections 33 of grooves 30. It can be appreciated that the second longitudinal axis of each of first and second handles 4 is coincident to the first longitudinal axis of bar 3. Furthermore, padding member 64 of each of first and second handles 4 presses against an end face of one of ends 31 of bar 3 and is slightly deformed along the second longitudinal axis. Then, each of first and second handles 4 is rotated through an angle to move the exposed ends of engaging member 221 into transverse section 34. Disengagement of each of first and second handles 4 from bar 3 by moving first and second handles 4 along the first or second longitudinal axis is, thus, avoided. Furthermore, the resilient returning force of the deformed padding members 64 exert a longitudinal force along the second longitudinal axis against a lateral wall of each transverse section 34 perpendicular to the first longitudinal axis, further avoiding disengagement of first and second handles 4. Namely, slackening between bar 3 and first and second handles 4 is avoided. First and second handles 4 can be detached from bar 3 through reverse operation.

Pull exerciser 10 can be utilized with one or more elastic cords 1 according to needs. In the preferred forms shown in FIGS. 1-12 and 15, pull exercisers 10 is utilized with an elastic cord 1 having first and second ends 11 and 12 and an intermediate portion 13 between first and second ends 11 and 12. Specifically, each of first and second ends 11 and 12 of elastic cord 1 extends through first, second, and third through-holes 46, 52, and 58 of cord mounting section 40 of one of first and second handles 4. Each of first and second ends 11 and 12 of elastic cord 1 can be extended through first, second, and third through-holes 46, 52, and 58 in sequence. Specifically, first end 11 of elastic cord 1 is extended through second opening 50 and then first opening 48 of first through-hole 46 of cord mounting section 40 of first handle 4. Next, first end 11 of elastic cord 1 is extended through first opening 54 and then second opening 56 of second through-hole 52. Next, first end 11 of elastic cord 1 is extended through second opening 62 and then first opening 60 of third through-hole 58. Such a winding manner securely retains first end 11 of elastic cord 1 on cord mounting section 40 of first handle 4. When elastic cord 1 is pulled, a section of first end 11 of elastic cord 1 extending through third through-hole 59 effectively prevents disengagement of first end 11 of elastic cord 1. Likewise, second end 12 of elastic cord 2 is extended through first, second, and third through-holes 46, 52, and 58 of cord mounting section 40 of second handle 4, obtaining the same advantages. In the preferred form shown in FIG. 15, the disengagement preventing effect is further enhanced by the non-parallel relation between first, second, and third through-holes 46, 52, and 58 of cord mounting section 40 of each of first and second handles 4.

Pull exercisers shown in FIGS. 1-12 and 15 can be used in different ways. In an example shown in FIG. 8, the user grips bar 3 with two feet stepping on intermediate portion 13. The user can raise bar 3 for exercising purposes. In another example shown in FIG. 9, the user places bar 3 at his or her back of his or her neck and grips first and second handles 4. The user can raise bar 3 and bend and stretch his or her legs to obtain a different exercising effect. In a further example shown in FIG. 10, the user grips first and second handles 4 with one foot stepping on intermediate portion 13. The user can raise bar 3 and bend and stretch his or her legs to obtain another exercising effect. In still another example shown in FIG. 11, bar 3 can be detached, and the user grips first and second handles 4 with two feet stepping on intermediate portion 13. The user can raise first and second handles 4 to obtain another exercising effect. In yet another example shown in FIG. 12, a longer section of each of first and second ends 11 and 12 of elastic cord 1 can be left after passing through third through-holes 58 of cord mounting sections 40. This shortens the operative length of elastic cord 1 and increases the elastic coefficient of elastic cord 1. Different exercising effects can, thus, be obtained. Furthermore, pull exerciser 10 according to the preferred teachings of the present invention can be utilized with different users of different heights by adjusting the operative length of elastic cord 1.

Figure 13:
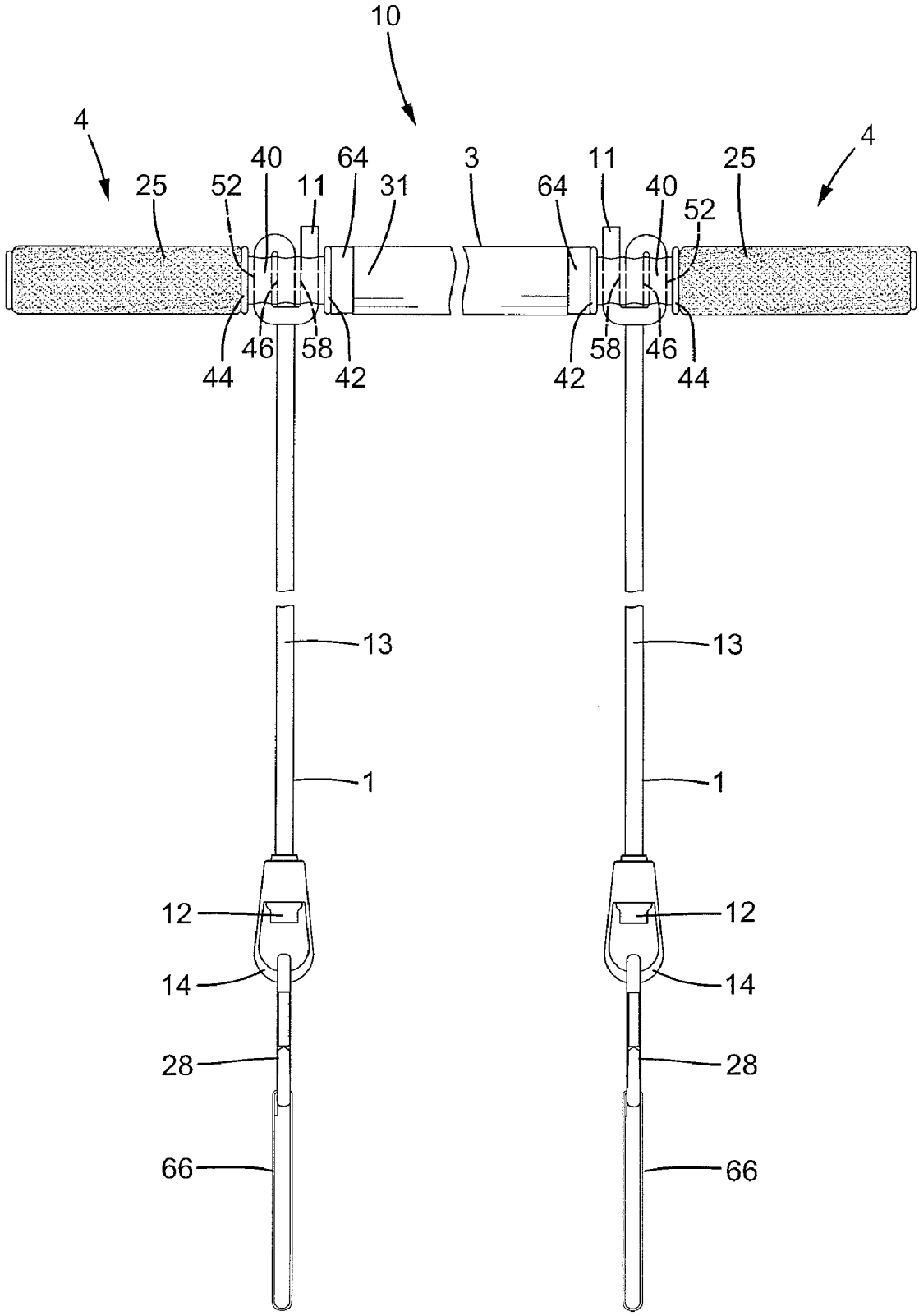
FIG. 13 shows a partial, perspective view of a pull exerciser of another embodiment according to the preferred teachings of the present invention.
Figure 14:
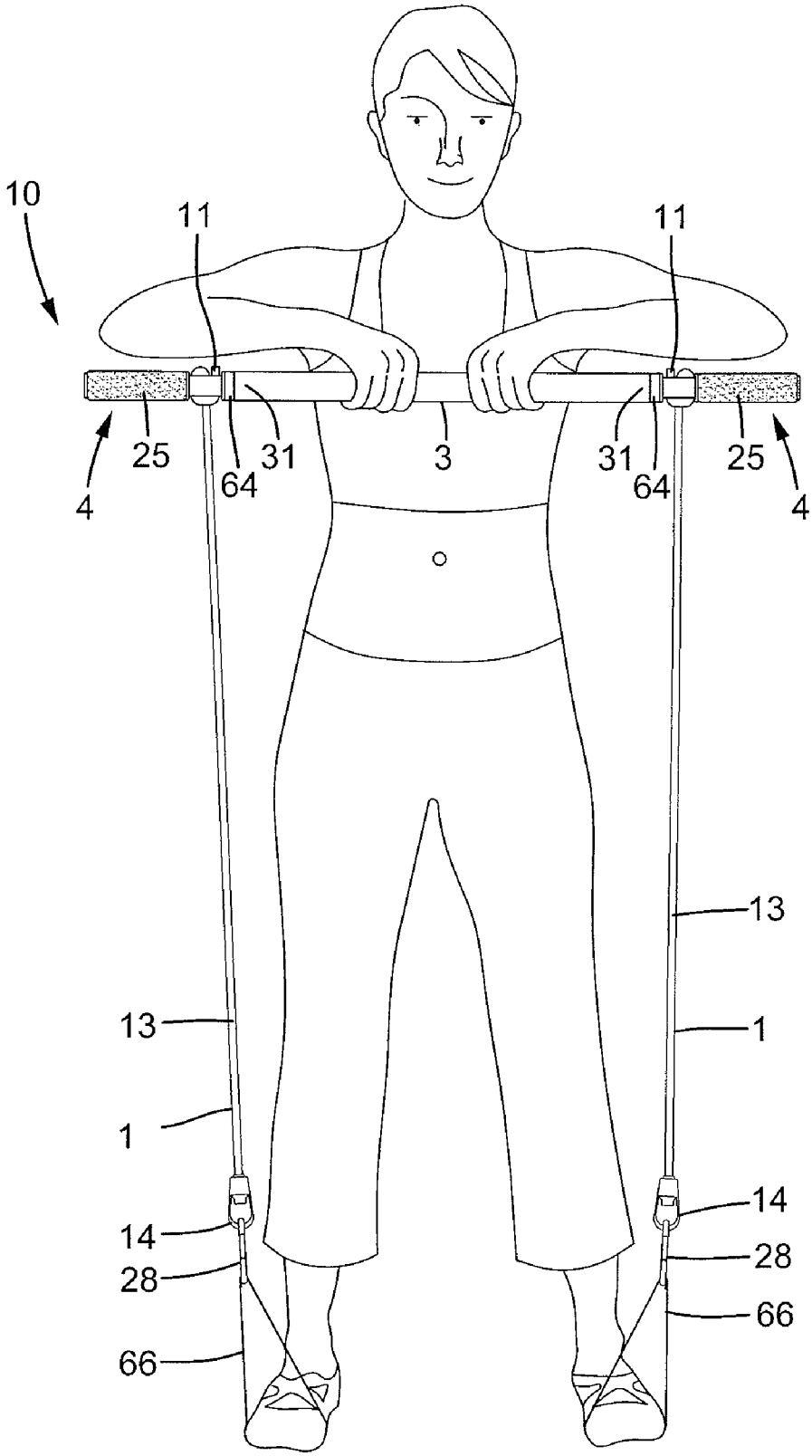
FIG. 14 shows a perspective illustrating use of the pull exerciser of FIG. 13.
Figure 15:
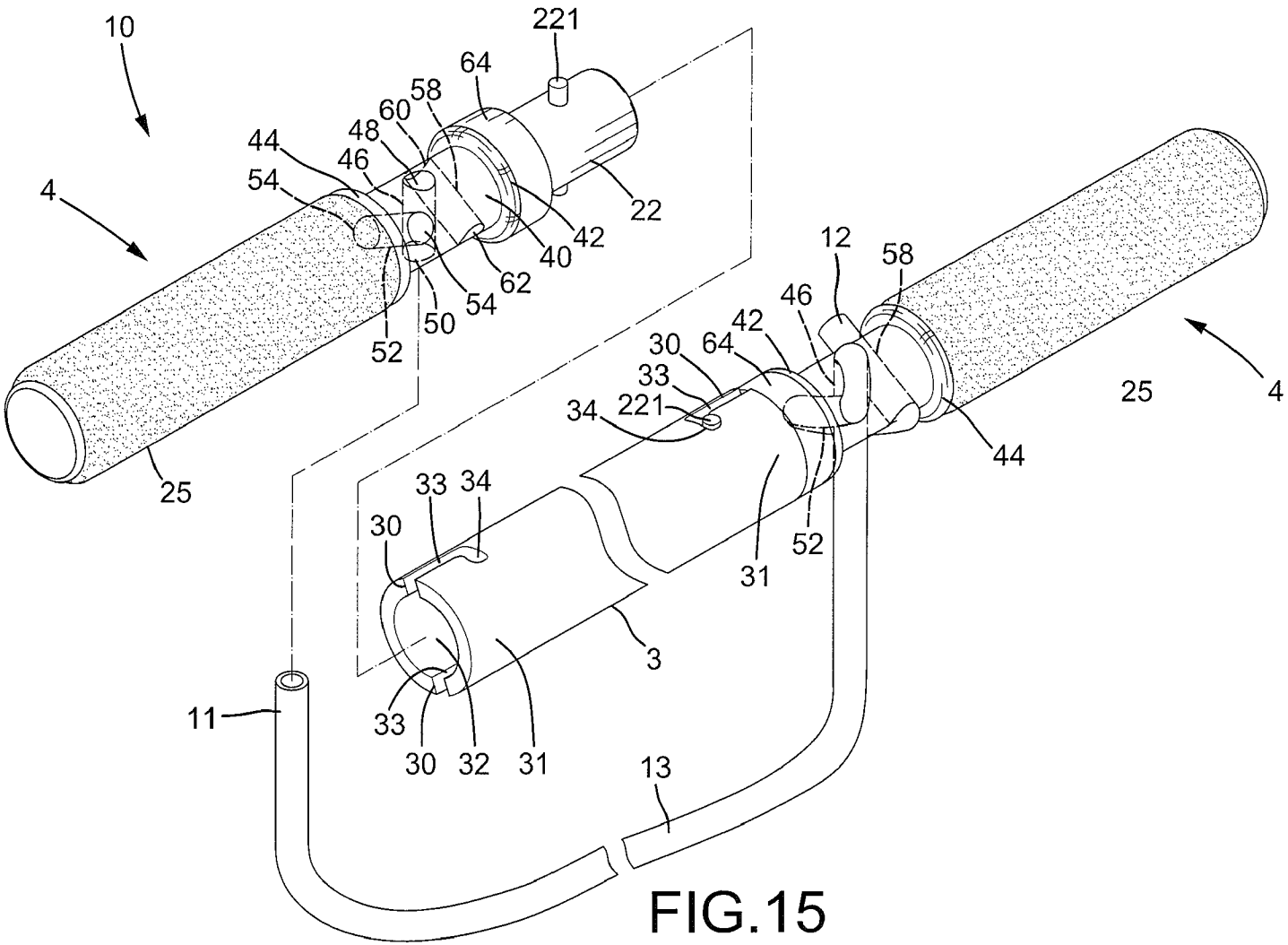
FIG. 15 shows a partial, exploded, perspective view of a pull exerciser of a further embodiment according to the preferred teachings of the present invention.

In the preferred form shown in FIGS. 13 and 14, pull exerciser 10 is utilized with two elastic cords 1. First end 11 of each elastic cord 1 extends through first, second, and third through-holes 46, 52, and 58 of cord mounting section 40 of one of first and second handles 4. An attachment member 14 is mounted to second end 12 of each elastic cord 1. A buckle 28 is engaged with each attachment member 14. A loop 66 such as a rubber ring can be removably connected to each buckle 28. In use, the user holds bar 3 with two feet received in loops 66. The user can raise bar 3 for exercising purposes. It can be appreciated that attachment members 14 at second ends 12 of elastic cords 1 can be engaged with screws or pegs fixed to a wall to obtain a different exercising effect.

Now that the basic teachings of the present invention have been explained, many extensions and variations will be obvious to one having ordinary skill in the art. For example, engaging hole 32 can be replaced with two recesses respectively formed in two end faces of bar 3 with each groove 30 in communication with one of the recesses. Furthermore, engaging member 221 can be replaced with two diametrically disposed protrusions on an outer periphery of connecting portion 22. Further, each end 31 of bar 3 can include only one groove 31, and engaging member 221 can be in the form of a pin having only one exposed end or be in the form of a protrusion. Further, first and second ends 11 and 12 of elastic cord 1 can be extended through first, second, and third through-holes 46, 52, and 58 in other sequences.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A pull exerciser comprising, in combination: a bar including first and second ends spaced along a first longitudinal axis and an engaging hole extending from the first end through the second end along the first longitudinal axis; first and second handles each including a grip portion and a connecting portion spaced from the grip portion along a second longitudinal axis and a cord mounting section intermediate the grip portion and the connecting portion, with the connecting portion of each of the first and second handles releasably mounted to one of the first and second ends of the bar, with the cord mounting section of each of the first and second handles including first, second, and third through-holes spaced along the second longitudinal axis, a first elastic cord including first and second ends, with the first end of the first elastic cord extended through and retained in the first, second, and third through-holes of the cord mounting section of the first handle, with each of the first and second ends of the bar including a groove having a first longitudinal section extending from one of the first and second ends towards but spaced from the other of the first and second ends of the bar, with the groove further including a transverse section extending perpendicularly to the longitudinal section from the longitudinal section, with the connecting portion of each of the first and second handles including an engaging member engaged in the groove of one of the first and second handles by moving through the longitudinal section of the groove of one of the first and second ends of the bar along the first longitudinal section and then moving into the transverse section of the groove of one of the first and second ends of the bar, with a flange formed between the connecting portion and the cord mounting section of each of first and second handles, with the pull exerciser further comprising, in combination: a padding member mounted around the connecting portion of the cord mounting section of each of the first and second handles and abutting the flange, with the padding member pressing against an end face of one of the first and second ends of the bar and deformed along the second longitudinal axis before the engaging member is moved into the transverse section, with resilient returning force of the deformed padding member exerting a longitudinal force along the second longitudinal axis against a lateral wall of the transverse section perpendicular to the first longitudinal axis when the engaging member is engaged in the transverse section.

2. The pull exerciser as claimed in claim 1, with the second end of the first elastic cord extended through and retained in the first, second, and third through-holes of the cord mounting section of the second handle.

3. The pull exerciser as claimed in claim 1, further comprising, in combination: a flange formed between the grip portion and the cord mounting section of each of the first and second handles; and a padding member mounted around the grip portion and abutting the flange, preventing the flange from moving to the cord mounting section.

4. The pull exerciser as claimed in claim 1, with the first, second, and third through-holes of the cord mounting section of each of the first and second handles being parallel to each other, with the first through-hole located intermediate the first, second and third through-holes along the first longitudinal axis, with the first end of the elastic cord extending through the first, second, and third through-holes in sequence.

5. The pull exerciser as claimed in claim 1, with the first, second, and third through-holes of the cord mounting section of each of the first and second handles being at a non-parallel angle to each other.

6. The pull exerciser as claimed in claim 5, with the first, second, and third through-holes of the cord mounting section of each of the first and second handles being at 60° to each other.

7. The pull exerciser as claimed in claim 1, further comprising, in combination: a second elastic cord having first and second ends, with the first end of the second elastic cord extended through and retained in the first, second, and third cord mounting section of the second handle.

8. The pull exerciser as claimed in claim 7, further comprising, in combination: an end piece mounted to the second end of each of the first and second elastic cords; and a loop releasably engaged with the end piece on the second end of each of the first and second handles.

* * * * *